US011384925B1

(12) United States Patent
Zeman et al.

(10) Patent No.: US 11,384,925 B1
(45) Date of Patent: Jul. 12, 2022

(54) LIGHT FIXTURE AND MOUNT WITH MULTIPLE ADJUSTMENTS

(71) Applicant: Hunter Industries, Inc., San Marcos, CA (US)

(72) Inventors: Adam Zeman, Del Mar, CA (US); Darrin I. Schmuckle, Vista, CA (US); Juan C. Gomez, San Marcos, CA (US)

(73) Assignee: Hunter Industries, Inc., San Marcos, CA (US)

( * ) Notice: Subject to any disclaimer, the term of this patent is extended or adjusted under 35 U.S.C. 154(b) by 0 days.

(21) Appl. No.: 17/302,316

(22) Filed: Apr. 29, 2021

(51) Int. Cl.

| | |
|---|---|
| ***F21V 21/30*** | (2006.01) |
| ***F21S 8/08*** | (2006.01) |
| ***F21V 17/12*** | (2006.01) |
| ***F21W 131/109*** | (2006.01) |

(52) U.S. Cl.
CPC ..... *F21V 21/30* (2013.01); *F21S 8/081* (2013.01); *F21V 17/12* (2013.01); *F21W 2131/109* (2013.01)

(58) Field of Classification Search
CPC ..... F21V 21/30; F21V 17/12; F21V 29/767; F21S 8/081; F21W 2131/109
See application file for complete search history.

(56) References Cited

U.S. PATENT DOCUMENTS

| | | | | |
|---|---|---|---|---|
| 2,129,933 | A * | 9/1938 | Hueglin | F04D 29/646 416/244 R |
| 3,104,064 | A | 9/1963 | Bellek | |
| D209,416 | S | 11/1967 | Smith | |
| 3,519,726 | A | 7/1970 | Ewing | |
| 3,524,981 | A | 8/1970 | Auerbach | |
| 3,679,886 | A | 7/1972 | Pizzey | |
| D242,945 | S | 1/1977 | Moore | |
| 4,180,850 | A | 12/1979 | Bivens | |
| 4,290,094 | A | 9/1981 | Jensen | |
| 4,874,991 | A | 10/1989 | Ruskin | |
| 4,974,134 | A | 11/1990 | Bourne | |
| 5,136,493 | A | 8/1992 | Straus et al. | |
| 5,337,993 | A | 8/1994 | Hersman | |
| 5,349,134 | A | 9/1994 | Russell | |
| 5,450,303 | A * | 9/1995 | Markiewicz | F16M 11/10 248/183.2 |

(Continued)

OTHER PUBLICATIONS

UL1598 cover page and p. 13, dated Dec. 30, 2004.

(Continued)

*Primary Examiner* — Jong-Suk (James) Lee
*Assistant Examiner* — James M Endo
(74) *Attorney, Agent, or Firm* — Knobbe Martens Olson & Bear, LLP

(57) ABSTRACT

An adjustable landscape light assembly for securing to a surface includes a light fixture and a mount. The light fixture includes a first engagement structure configured to engage with a first engagement structure of the mount while allowing the light fixture to be rotated relative to the mount. The light assembly includes a locking member configured to move between a first position and a second position. The locking member engages with both the light fixture and the mount when in the second position to prevent the light fixture from being rotated relative to the mount and disengages from the mount when moved to the first position.

16 Claims, 6 Drawing Sheets

(56) References Cited

U.S. PATENT DOCUMENTS 5,535,109 A * 7/1996 Moore ..... F21V 29/89 362/267
5,584,574 A * 12/1996 Haddad ..... F21V 11/00 362/280
5,599,091 A 2/1997 Kira
D381,449 S 7/1997 Metchear, III
5,649,760 A 7/1997 Beadle
5,655,829 A 8/1997 Lin et al.
D388,900 S 1/1998 Metchear, III
5,704,704 A 1/1998 Reichard et al.
D393,089 S 3/1998 Metchear, III
5,800,053 A 9/1998 Shen
5,829,913 A 11/1998 Puckett
6,059,429 A * 5/2000 Bodell ..... F16M 11/06 362/269
6,135,624 A 10/2000 Masters et al.
6,161,948 A * 12/2000 Hagen ..... F16M 11/10 362/267
D442,312 S 5/2001 Metchear, III
6,266,250 B1 7/2001 Foye
D446,330 S 8/2001 Metchear, III
6,280,056 B1 * 8/2001 Dolan ..... F21S 6/008 362/249.1
6,299,075 B1 10/2001 Koller
6,357,892 B1 3/2002 Beadle
6,386,729 B1 5/2002 Bober
6,422,717 B1 7/2002 Beadle
6,443,783 B1 9/2002 Beadle
6,491,407 B1 12/2002 Beadle
6,497,592 B1 12/2002 Beadle
6,575,591 B1 6/2003 De Lany
6,583,700 B1 6/2003 Beadle
6,612,720 B1 9/2003 Beadle
6,652,113 B2 11/2003 Tant
6,752,516 B1 6/2004 Beadle
6,779,907 B2 8/2004 Beadle
6,786,622 B1 9/2004 Rice
6,796,684 B1 9/2004 Beadle
6,799,869 B1 10/2004 Beadle
6,874,905 B1 4/2005 Beadle
6,902,200 B1 * 6/2005 Beadle ..... F16C 11/04 285/185
6,957,782 B2 10/2005 Clark et al.
6,966,679 B2 * 11/2005 Matts ..... F16C 11/103 362/267
7,108,394 B1 9/2006 Swarens
7,226,189 B2 6/2007 Lee et al.
7,320,533 B1 1/2008 Beadle
7,387,409 B1 6/2008 Beadle
D573,297 S 7/2008 Beadle
7,470,895 B1 12/2008 Cramer et al.
7,520,644 B2 4/2009 Jordan et al.
7,614,769 B2 11/2009 Sell
7,712,925 B2 5/2010 Russell
7,874,709 B1 1/2011 Beadle
7,993,040 B2 8/2011 Beadle
D670,848 S 11/2012 Reo
8,390,207 B2 3/2013 Dowling et al.
8,419,205 B1 4/2013 Schmuckle
8,602,613 B2 12/2013 Pike et al.
8,672,502 B2 3/2014 Hartman
8,714,767 B2 5/2014 Sears
8,753,030 B2 * 6/2014 Leonhardt ..... F16M 11/2014 403/114
8,783,916 B2 7/2014 Tyson et al.
9,213,361 B1 12/2015 Urban
9,476,580 B2 10/2016 Treurniet et al.
9,897,296 B1 * 2/2018 Baldwin ..... F21V 31/005
D824,563 S 7/2018 Sonneman
D826,446 S 8/2018 Chami et al.
10,151,453 B2 * 12/2018 Duckworth ..... F21V 29/763
D849,297 S 5/2019 Deng
D855,231 S 7/2019 Huang
10,415,809 B2 * 9/2019 Thomas ..... F21V 15/01
D882,142 S 4/2020 Huang
10,746,382 B2 * 8/2020 Mullen ..... F21V 21/28
D900,372 S 10/2020 Peng
2001/0014021 A1 8/2001 Duff et al.
2001/0033487 A1 10/2001 Crelin
2001/0048056 A1 12/2001 Gauci
2004/0100787 A1 5/2004 Harris
2004/0120141 A1 6/2004 Beadle
2005/0099802 A1 5/2005 Lai
2005/0103378 A1 5/2005 Pu et al.
2005/0135101 A1 6/2005 Richmond
2005/0174774 A1 8/2005 Lunt
2006/0114680 A1 6/2006 Miller
2007/0008717 A1 1/2007 Flaherty
2007/0091585 A1 4/2007 Hedman
2007/0171655 A1 7/2007 Lai
2008/0273333 A1 11/2008 Berns et al.
2009/0040774 A1 * 2/2009 Avila ..... F21V 21/28 362/371
2009/0122564 A1 5/2009 Beadle
2009/0296412 A1 * 12/2009 Ogawa ..... F21V 23/005 362/373
2010/0084985 A1 4/2010 Woytowitz
2010/0265715 A1 * 10/2010 Winstanley ..... F21V 23/00 362/277
2010/0284173 A1 11/2010 Verjans et al.
2011/0018448 A1 1/2011 Metchear, III et al.
2011/0063849 A1 3/2011 Alexander et al.
2011/0255293 A1 10/2011 Lipscomb et al.
2011/0267834 A1 11/2011 Potucek et al.
2011/0303764 A1 12/2011 Roth
2012/0051068 A1 3/2012 Pelton et al.
2012/0236547 A1 9/2012 Hartman
2012/0250337 A1 10/2012 Pike et al.
2012/0274219 A1 11/2012 Woytowitz et al.
2012/0314429 A1 12/2012 Plunk
2013/0063946 A1 3/2013 Preuschl
2013/0208489 A1 * 8/2013 Schmuckle ..... F21K 9/20 362/363
2014/0099093 A1 4/2014 Johnson, Sr. et al.
2014/0301066 A1 10/2014 Inskeep
2014/0313775 A1 10/2014 Myers et al.
2014/0362564 A1 12/2014 Giblett
2015/0260385 A1 * 9/2015 Brynjolfsson ..... H05B 47/195 315/152
2016/0003432 A1 1/2016 Sorensen et al.
2017/0045212 A1 * 2/2017 Ghasabi ..... F21V 21/0824
2017/0191631 A1 7/2017 Lentine et al.
2017/0219188 A1 8/2017 Veloskey
2017/0261842 A1 9/2017 Johnson, Sr. et al.
2018/0313504 A1 11/2018 Eberts et al.
2019/0101256 A1 4/2019 Hartman

OTHER PUBLICATIONS

Vista Professional Outdoor Lighting Installation Instructions for the 4260 Landscape Series Step & Brick Lights; downloaded Nov. 12, 2018.

FXLuminaire Price List 2015, Architectural and Landscaping Lighting, The Intersection of Art & Engineering, Hunter Industries, Inc., dated 2014 in 3 pages.

* cited by examiner

LIGHT FIXTURE AND MOUNT WITH MULTIPLE ADJUSTMENTS

BACKGROUND OF THE INVENTION

Field of the Invention

The present invention relates to mounts for light fixtures, and more particularly, to an adjustable landscape light assembly that includes a mount for installation around lawns and gardens of residential and commercial properties.

Description of the Related Art

Outdoor landscape lighting is popular for security, aesthetic, safety, and other reasons. It is known in the outdoor lighting industry to mount a landscape light fixture on the top of a mounting stake whose lower end is planted in the ground. This secures the light fixture in a fixed position and keeps it in place.

Typical commercially available landscape light fixture mounts are attached to an electrical junction box or a stake with a lower pointed end and a threaded top portion for receiving a light fixture. When using an electrical junction box, a user will first mount the junction box to an appropriate structure and attach the light fixture with the mount to the electrical junction box. When using a stake, a user will secure the light fixture mount to the stake and place the stake in the ground. Alternatively, a user might first pound the stake into the ground before affixing the light fixture.

SUMMARY OF THE INVENTION

Many light fixtures include a pivot to allow a user to aim the light fixture at the intended feature. This can be done by adjusting the angle of the light fixture relative to the horizon. Many light fixtures also include an adjustable shroud. The shroud is often rotatable around the body of the light fixture so the user can aim the shroud in a desired position. In some fixtures, the shroud may not be adjustable. In some cases, a light fixture without an adjustable shroud can be rotated at the mount relative to the axis of the body of the light fixture.

In accordance with some embodiments, an adjustable landscape light assembly for securing to a surface can include a light fixture comprising a body having a first end and a second end. The second end has a first engagement structure. The light fixture can further include a mount configured to be secured relative to the surface. The mount comprises a second engagement structure. The second engagement structure is sized and shaped to engage with the first engagement structure while allowing the light fixture to be rotated relative to the mount. The light fixture can further include a locking member configured to move between a first position and a second position. The locking member engages with both the light fixture and the mount when in the second position to prevent the light fixture from being rotated relative to the mount and disengaging from the mount when moved to the first position.

In some variants, the locking member engages the first and second engagement structures when in the second position.

In some variants, the locking member is a screw.

In some variants, the light fixture further comprises a hole disposed in the first engagement structure and sized and shaped to engage the locking member.

In some variants, the mount further comprises a contact surface disposed in the second engagement structure and positioned to be contacted by the locking member when the locking member is in the second position.

In some variants, the mount further comprises a groove, and wherein the contact surface is disposed in the groove.

In some variants, the light assembly further comprises a shroud engaged with the first end of the body, the shroud comprising a lens.

In some variants, the light assembly further comprises a light module supported by the first end of the body. The light module has one or more lights configured to emit light through the lens when the shroud is engaged with the first end of the body.

In some variants, the mount is at least partially hollow to allow a wire connected to the light module to pass therethrough.

In some variants, the mount comprises a fixture mount and a base. The fixture mount is rotatable relative to the base.

In accordance with some embodiments, an adjustable landscape light assembly for securing to a surface can include a light fixture comprising a body having a first end and a second end. The second end has a first engagement structure. The light assembly can further include a mount comprising a base and a fixture mount. The base is configured to be secured relative to the surface. The fixture mount is rotatable relative to the base and has a second engagement structure. The second engagement structure is sized and shaped to engage with the first engagement structure while allowing the light fixture to be rotated relative to the fixture mount. The light assembly can further include a locking member configured to move between a first position and a second position. The locking member engages with both the light fixture and the fixture mount when in the second position to prevent the light fixture from being rotated relative to the fixture mount and disengaging from the fixture mount when moved to the first position.

In some variants, the locking member engages the first and second engagement structures when in the second position.

In some variants, the locking member is a screw.

In some variants, the light fixture further comprises a hole disposed in the first engagement structure and sized and shaped to engage the locking member.

In some variants, the fixture mount further comprises a contact surface disposed in the second engagement structure and positioned to be contacted by the locking member when the locking member is in the second position.

In some variants, the fixture mount further comprises a groove. The contact surface is disposed in the groove.

In accordance with some embodiments, an adjustable landscape light assembly for securing to a surface can include a body having a first end and a second end. The second end has a first engagement structure. The light assembly can further include a shroud engaged with the first end of the body and having a lens and a light module supported by the first end of the body and having one or more lights. The one or more lights are configured to emit light through the lens at least when the shroud is engaged with the first end of the body. The light assembly can further include a mount comprising a base and a fixture mount. The base is configured to be secured relative to the surface. The fixture mount is rotatable relative to the base and has a second engagement structure, the second engagement structure being sized and shaped to engage with the first engagement structure while allowing the body to be rotated relative to the fixture mount. The light assembly can further include a locking member configured to move between a first position and a second position. The locking member engages with both the body and the fixture mount when in the second position to prevent the body from being rotated relative to the fixture mount and disengaging from the fixture mount when moved to the first position.

In some variants, the light assembly further comprises a stud, the stud being configured to be secured between the base and the surface.

In some variants, the base comprises a hole sized and shaped to receive a fastener. The stud comprises a groove aligned with the hole and configured to be contacted by the fastener so as to prevent rotation of the base relative to the stud when the fastener is tightened against the groove.

In some variants, the body comprises an outer surface and one or more fins disposed on the outer surface.

BRIEF DESCRIPTION OF THE DRAWINGS

Various embodiments are depicted in the accompanying drawings for illustrative purposes and should in no way be interpreted as limiting the scope of the inventions, in which like reference characters denote corresponding features consistently throughout similar embodiments.

DETAILED DESCRIPTION

Outdoor lighting can be used to highlight features on buildings, illuminate pathways, highlight various plants to provide an aesthetic appeal and to improve security and safety in an outdoor environment.

According to the present disclosure, as illustrated and described below, an outdoor light assembly that includes a mount that can be configured to aim a light to a desired direction and to orient the light fixture relative to the mount so as to provide the desired lighting effect.

Figure 1:
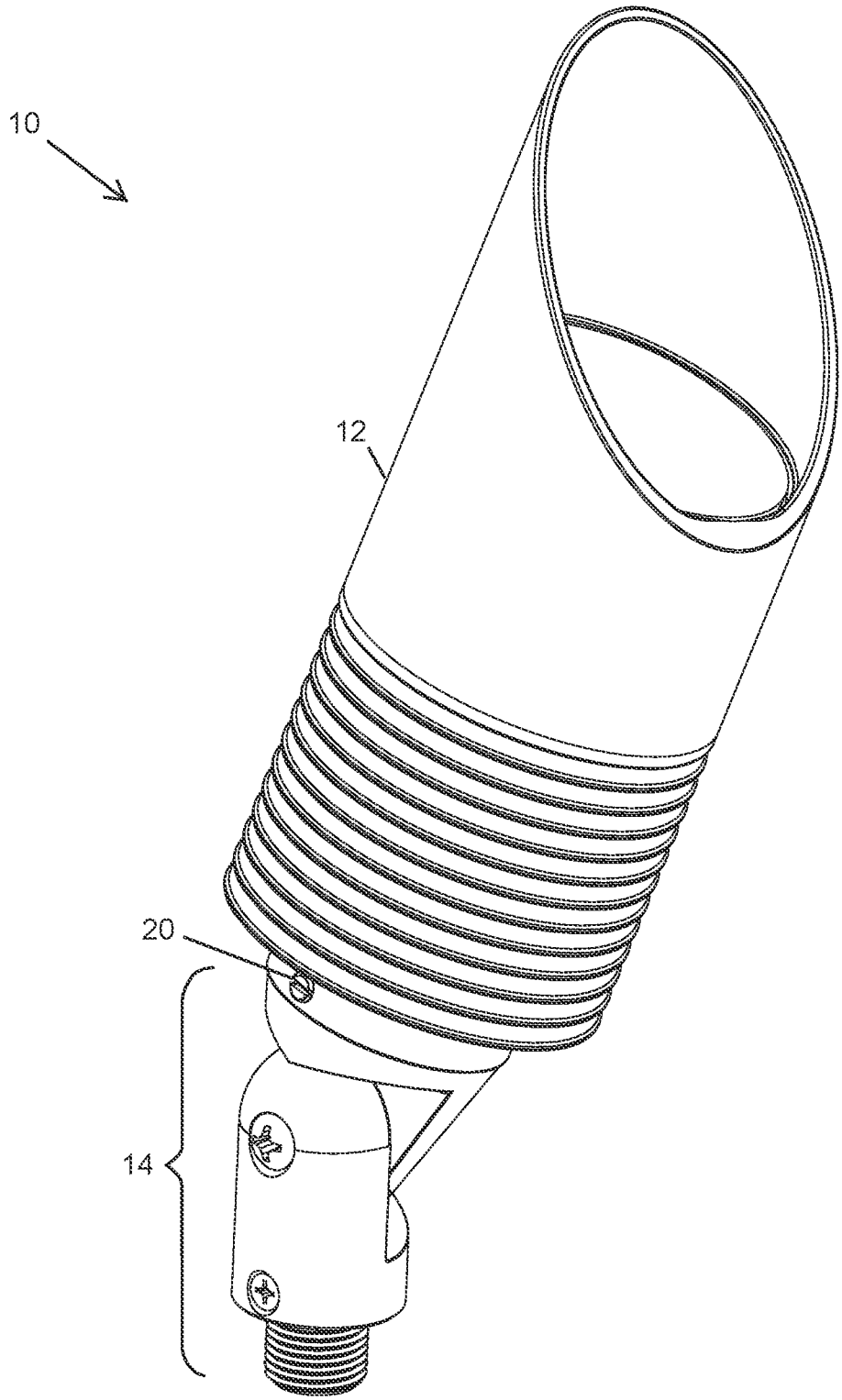
FIG. 1 is a perspective view of a light assembly that includes a generally cylindrical light fixture attached to a mount with multiple adjustments according to a preferred embodiment of the present invention. The light fixture in FIG. 1 is angled at approximately 15 degrees relative to the mount and is selectively rotatable about a longitudinal axis of the mount.

FIG. 1 is a perspective view of a light assembly 10 that includes a generally cylindrical light fixture 12 attached to a mount 14 with multiple adjustments according to a preferred embodiment of the present invention. The light fixture 12 in FIG. 1 is angled at approximately 15 degrees relative to the mount 14 and is selectively rotatable about a longitudinal axis of the mount 14 as further describe below.

Figure 2:
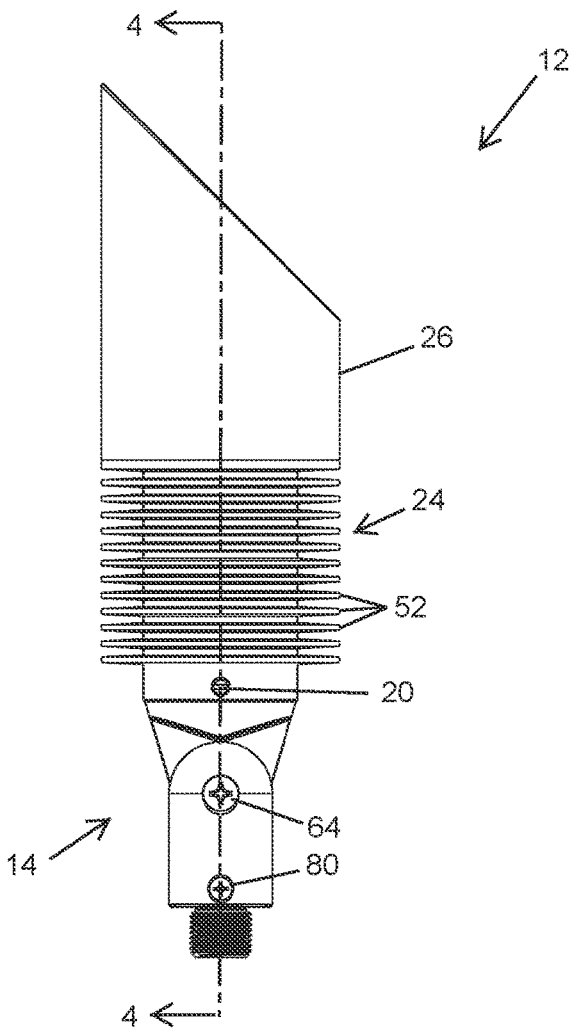
FIG. 2 is a left side view of the light fixture and the mount from FIG. 1 with the light fixture adjusted to a vertical position relative to the mount. Engagement of a locking member with a contact surface of the mount inhibits rotation of the light fixture relative to the mount.

FIG. 2 is a left side view of the light fixture 12 and the mount 14 from FIG. 1 with the light fixture 12 adjusted to a vertical position relative to the mount 14. As further described below in certain embodiments, engagement of a locking member 20 with a contact surface 22 of the mount 14 inhibits rotation of the light fixture 12 about a longitudinal axis of the mount 14.

Referring to FIGS. 1 and 2 in certain embodiments, the mount 14 supports the light fixture 12, for example, from an electrical junction box or above a stake while allowing the light fixture 12 to rotate about a longitudinal axis of the mount 14. For example, an end of the mounting stake can be inserted into the ground by a user at a desired location. Typically, a user will insert the mounting stake into soil, for example, a lawn or yard, although any relatively soft and penetrable body will suffice. Once inserted, the user can still rotate the light fixture 12 to a desired direction and then lock the light fixture 12 in place with the locking member 20.

The stake can include a pointed end. The pointed end is configured to allow the stake to be easily and securely inserted into soil, or any other relatively soft, penetrable body for positioning. Although the stake is typically inserted into the ground, for example a lawn or yard, it is envisioned that the mount 14 may be positioned anywhere a user may desire a landscape light fixture. Thus, alternatively, the stake may be replaced with other attachment means for securing the mount 14 in a desired location. For example, the stake can be replaced by a suction cup, a male threaded portion, a female threaded portion, a through hole for receiving a bolt, etc. For example, the mount 14 can be alternatively attached to an electrical junction box. The attachment means is not limited to the particular examples disclosed herein and other means can be used.

Figure 4:
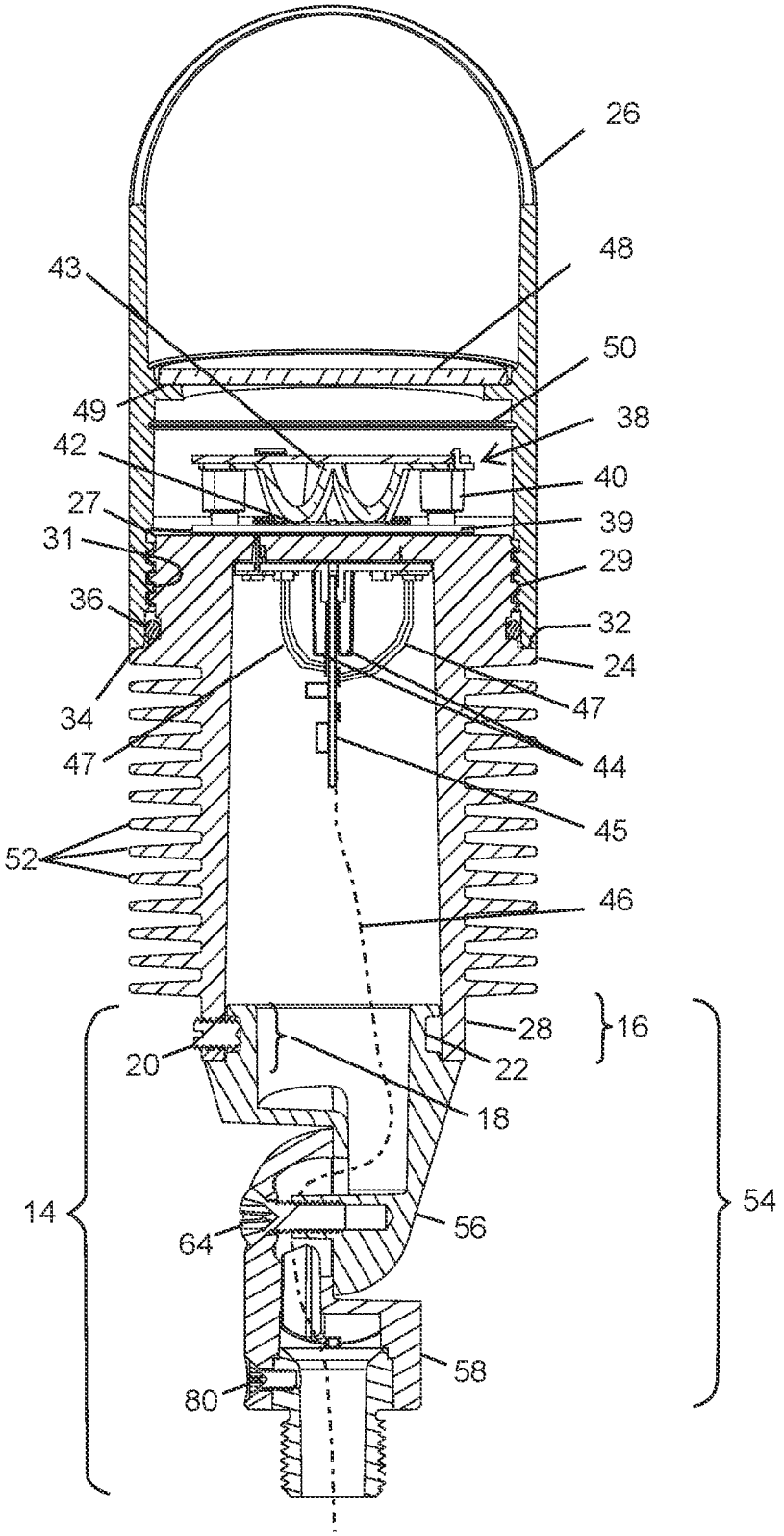
FIG. 4 is a section view of the light fixture and the mount from FIG. 2 taken along cut lines 4-4 of FIG. 2.

In certain embodiments, the light fixture 12 comprises a first engagement structure 16 (FIG. 4) which couples to a second engagement structure 18 on the mount 14 (FIG. 4). In certain embodiments, the user couples the first and second engagement structures 16, 18 together by placing the light fixture 12 on the mount 14. In certain embodiments, when placed on the mount 14, the first and second engagement structures 16, 18 prevent the light fixture 12 from falling off the mount 14 while allowing the user to freely rotate the light fixture 12 relative to the longitudinal axis of the mount 14.

In certain embodiments, the first engagement structure 16 is a lip of the light fixture 12 that projects in a downward direction towards the mount 14. In certain embodiments, the second engagement structure 18 is a lip of the mount 14 that projects in an upward direction towards the light fixture 12. In certain embodiments, diameters of the first and second engagement structures 16, 18 are complementary so that the first and second engagement structures 16, 18 can overlap with one another. Of course, the first and second engagement structures 16, 18 are not limited to the illustrated embodiment. For example, in certain other embodiments, the first and second engagement structures 16, 18 are configured as projections, fingers, and/or tabs which act to prevent the light fixture 12 from falling off the mount 14 while allowing the user to freely rotate the light fixture 12 relative to the mount 14. For example, in certain other embodiments, the first and second engagement structures 16, 18 can be screws or other fasteners known to a person having ordinary skill in the art.

Figure 3:
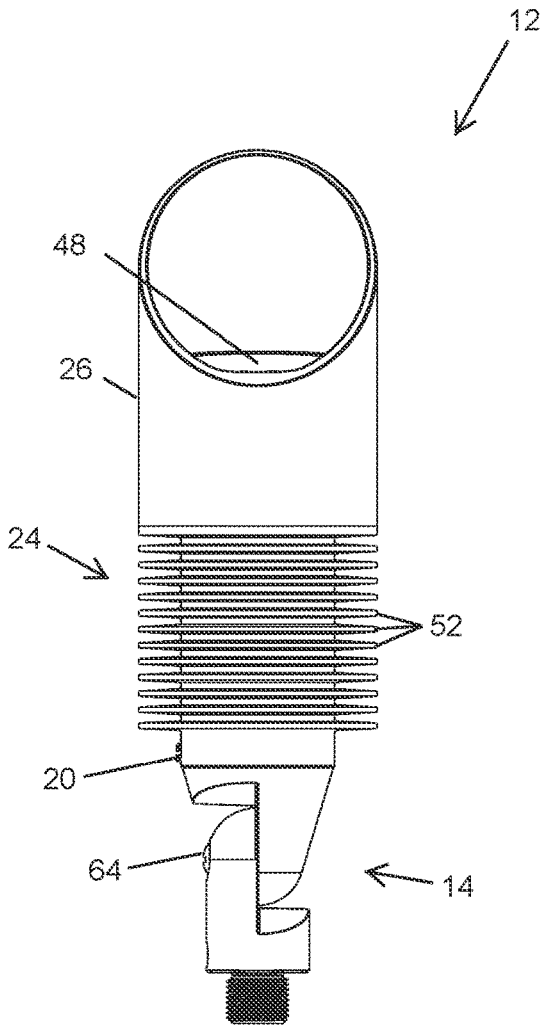
FIG. 3 is a front view of the light fixture and the mount from FIG. 2.

FIG. 3 is a front view of the light fixture 12 and the mount 14 from FIG. 2. Referring to FIGS. 2 and 3, in certain embodiments, the light fixture 12 comprises a body 24 and a shroud 26. In certain embodiments, the body 24 of the light fixture 12 is secured to the mount 14.

In certain embodiments, the body 24 can be manufactured out of brass, copper, bronze, aluminum, plastic or other material. In certain embodiments, the body 24 can be manufactured from a heat conductive material. In certain embodiment, heat emitted by a light module 38 (FIG. 4) is dissipated by the body 24. For example, in some embodiments, the body 24 dissipates heat from the light module 38 to the body 24 so as to protect the light module 38 from damage caused by the heat it produces. In certain embodiments, the body 24 comprises fins 52. In certain embodiments, the fins 52 are formed on the body 24 to increase an exposed surface area of the body 24. The additional surface area of the fins 52 promotes heat transfer (e.g., convection) from the body 24 to the ambient air. In this way, the ambient air can act as a heat sink to cool the body 24 and the light module 38 during operation.

FIG. 4 is a section view of the light fixture 12 and the mount 14 from FIG. 2 taken along cut lines 4-4 of FIG. 2. Referring to FIGS. 3 and 4, in certain embodiments, the body 24 can have a first end 27 and a second end 28. In certain embodiments, the first end 27 of the body 24 can be formed with threads 29. In some embodiments, the shroud 26 can be formed with threads 31 near an open end 30 of the shroud 26.

In the illustrated embodiment, the threads 29 are disposed on an outer surface of the body 24 and are positioned to engage with the threads 31 of the shroud 26 to secure the shroud 26 to the body 24 of the light fixture 12. In other embodiments, the shroud 26 can be securely attached to the body 24 using a press fit between the body 24 and the shroud 26. In some other embodiments, the shroud 26 can be secured to the body 24 using one or more screws, pins, or other attachment structures.

In some embodiments, the shroud 26 can be attached to the body 24 by rotating the shroud 26 and engaging the threads 31 with the threads 29. In some embodiments, the shroud 26 can be rotated until the shroud 26 is tightly and securely fitted to the body 24. In certain embodiments, the threads 29, 31 can be tapered threads 29, 31 and the shroud 26 can tighten to the body 24 as the shroud 26 is threaded further in position. In some embodiments, the threads 29, 31 are not tapered. In certain embodiments, a contact surface 34 on the open end 30 of the shroud 26 will contact a contact surface 32 of the body 24 when the shroud 26 is fully threaded to the body 24.

In certain embodiments, the light assembly 10 comprises a seal 36. In certain embodiments, the seal 36 can provides a watertight connection between the body 24 and the shroud 26. In certain embodiments, the seal 36 is an O-ring placed between the body 24 and the shroud 26. In certain embodiments, the O-ring can be sandwiched between an outer diameter of the body 24 and an inner diameter of the shroud 26. In the illustrated embodiment, the seal 36 is disposed at a location between the threads 31 and the contact surface 34 of the shroud 26 when the shroud 26 is secured to the body 24.

In certain embodiments, the light assembly 10 includes a light module 38. In certain embodiments, the light module 38 can be configured to emit light out of the light assembly 10 through the shroud 26 in a desired direction. As is illustrated in FIG. 4, the light module 38 is secured to the body 24.

In certain embodiments, the light module 38 can include a support 40 and one or more light sources 42. In certain embodiments, the one or more light sources 42 can be one or more light emitting diodes (LEDs), incandescent bulbs, fluorescent bulbs, halogen bulbs, or high intensity discharge bulbs. In some embodiments, the one or more light sources 42 are one or more LEDs that emit a single color such as white, red, green, or blue mounted to a circuit board 39. In other embodiments, the one or more LEDs emit multiple colors such as by employing an array of controlled RGB LEDs. In some embodiments the one or more LEDs emit multiple colors as well as white light such as by employing an array of controlled RGBW LEDs. In some embodiments, the support 40 holds one or more lenses 43 over the one or more light sources.

In certain embodiments, the light assembly 10 can include one or more fasteners for releasably securing the light module 38 to the body 24. In certain embodiments, the fasteners can include screws, bolts, nuts, or any other suitable fasteners. In certain embodiments, the circuit board 39 can be sandwiched between the body 24 and the support 40. For example, in certain embodiments, the support 40 can include a plurality of apertures 41 for receiving the fasteners. In certain embodiments in which the fasteners are screws, the body 24 can have complementary threads configured to receive the screws.

In certain embodiments, the shroud 26 includes a lens 48. In certain embodiments, the lens 48 can be positioned to allow light from the one or more light sources 42 to project in at least one direction exterior to the light assembly 10. In certain embodiments, the lens 48 can be transparent or substantially transparent. In certain embodiments, the lens 48 can be frosted. In certain embodiments, the lens 48 may be tinted with a color. In certain embodiments, the lens 48 may be tinted with a color to change the color temperature of the light emitting from the light assembly 10. In certain embodiments, the lens 48 can protect the one or more light sources 42 from the outside environment when the shroud 26 is secured to the body 24.

In certain embodiments, the shroud 26 includes a filter 50. In certain embodiments, the filter 50 can be positioned between the one or more light sources 42 and the lens 48. In certain embodiments, the filter 50 can be transparent or substantially transparent. In certain embodiments, the filter 50 can be frosted. In certain embodiments, the filter 50 may be tinted with a color. In certain embodiments, the filter 50 may be tinted with a color to change the color temperature of the light emitting from the light assembly 10. In certain embodiments, the filter 50 can be a diffuser that blends the light output from each of the one or more light sources 42 to a more uniform pattern. In certain embodiments, the filter 50 can protect the one or more light sources 42 from the outside environment when the shroud 26 is secured to the body 24.

In certain embodiments, the shroud 26 comprises a mating portion 49. In certain embodiments, the mating portion 49 is configured to form a seal between the mating portion 49 and the lens 48. In certain embodiments, the mating portion 49 inhibits or prevents water or moisture ingress past the lens 48 and into the light assembly 10 when the shroud 26 is secured to the body 24. In certain embodiments, the mating portion 49 is an O-ring. In certain embodiments, the mating portion 49 is formed as an integral part of the shroud 26. In some embodiments, the lens 48 is secured to the mating portion 49 with a waterproof adhesive.

In certain embodiments, the light assembly 10 includes one or more clamps 44 for connecting a circuit board 45. In some embodiments, the circuit board 45 is electrically connected to the one or more light sources 42. In some embodiments, the circuit board 45 contains circuitry to drive the one or more LED light sources 42. In certain embodiments, the light module 38 can be electrically connected to the circuit board 45 by one or more wires 47. In some embodiments, the circuit board 45 is electrically connected to a power wire 46. In some embodiments, the power wire 46 can contain two wires. For example, in certain embodiments, the power wire 46 can be coupled to the circuit board 45 which is electrically connected through a portion of the body 24 to the light module 38. In certain embodiments, the light module 38 can be plugged into or removed from being electrically connected to the one or more wires 47 by the user.

In certain embodiments, components of the light fixture 12 and the mount 14 are hollow, or have hollowed out portions to provide a path for the power wire 46 to extend from the circuit board 45 through the light fixture 12 and the mount 14 to outside of the light assembly 10. In certain embodiments, the power wire 46 is configured to electrically connect with a source of electrical power. In certain embodiments, the circuit board 45 has one or more wires 47 configured to transfer power from the power wire 46 to the one or more light sources 42. In some embodiments the hollowed out portion of the body 24 can be filled, or partially filled with a potting compound to protect the circuit board 45 from moisture. In some embodiments, the potting compound acts to provide a strain relieve for the attachment point of the wire 46 to the circuit board 45.

Figure 5:
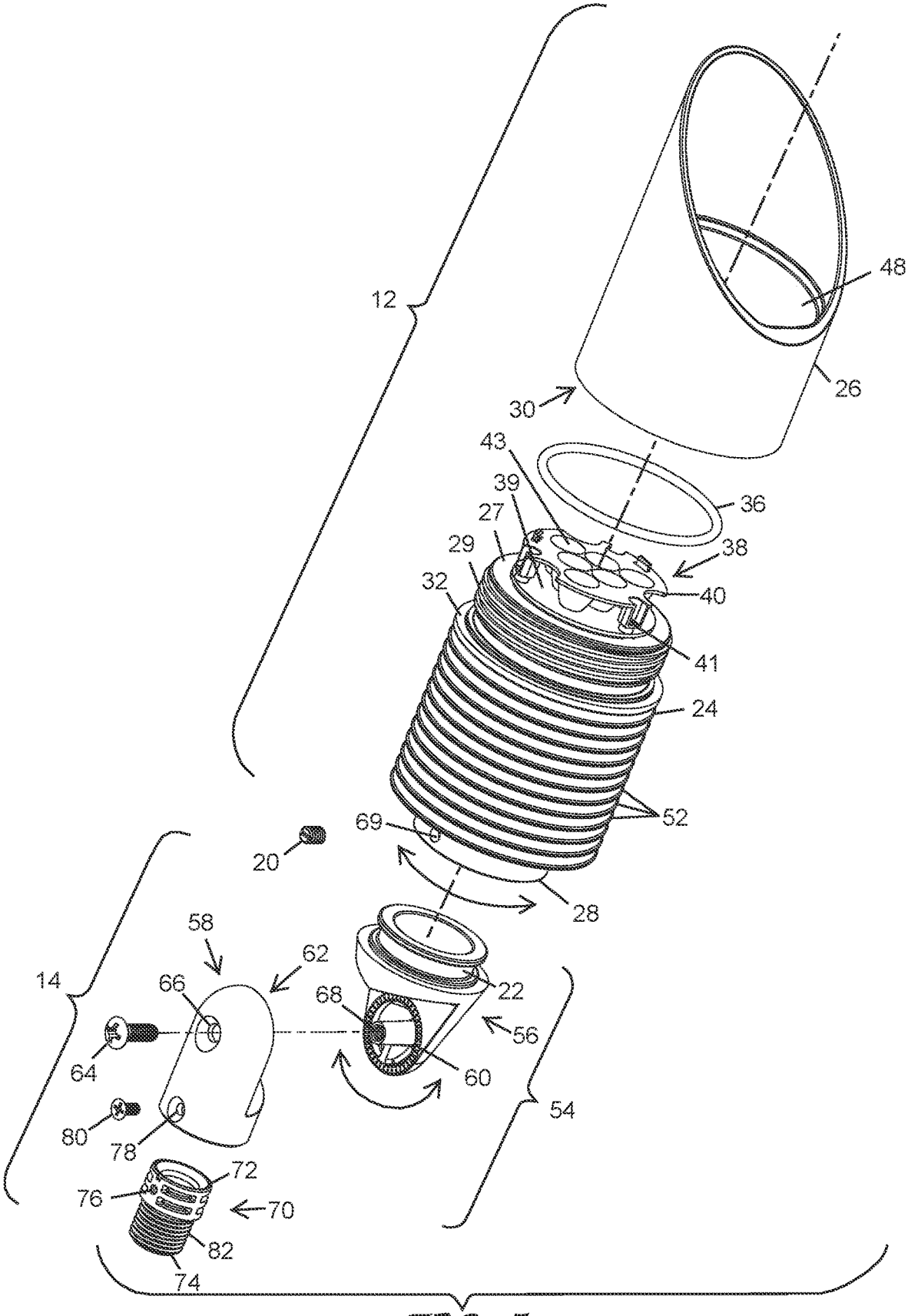
FIG. 5 is an exploded view of the light fixture and the mount from FIG. 2 showing, for example, the locking member disengaged from a groove in the mount and further removed from the light fixture. A base of the mount is attached to a stud.

FIG. 5 is an exploded view of the light fixture 12 and the mount 14 from FIG. 2. In certain embodiments, the mount 14 is formed as a knuckle 54. For example, in the illustrated embodiment, the knuckle 54 comprises a fixture mount 56 and a base 58. In some embodiments, the fixture mount 56 can be removably mounted to the base 58. In some embodiments, the fixture mount 56 can be rotationally mounted to the base 58. In certain embodiments, the fixture mount 56 can rotate relative to the base 58 about a longitudinal axis of a fastener 64 until the user fixes the light fixture 12 in a preferred orientation.

In certain embodiments, the fixture mount 56 comprises a hole 68 aligned with a hole 66 in the base 58. In certain embodiments, the hole 68 is threaded. The hole 68 may include female threads that correspond to male threads of the fastener 64. Alternatively, the hole 68 may include a through-hole that does not include threads. Such a through-hole can include a counterbore positioned on an outer side of the fixture mount 56. In use a male threaded portion of the fastener 64 is inserted through the hole 66 and through-hole 68 and a nut is screwed onto the fastener 64 such that it sits in the counterbore. The counterbore allows the nut to secure the fastener 64 to the fixture mount 56 while still maintaining a flat profile of the outer side of the fixture mount 56 opposite the head of the fastener 64.

In certain embodiments, the fastener 64 passes through the hole 66 in the base 58 and then is threaded in the hole 68 in the fixture mount 56 to fix the light fixture 12 in the preferred orientation relative to the base 58. For example, in certain embodiments, the user can loosen the fastener 64 to rotate the fixture mount 56 about the longitudinal axis of the fastener 64 to reach the preferred orientation of the light fixture 12. Once in the preferred orientation, the user can tighten the fastener 64 to fix the light fixture 12 relative to the base 58.

In certain embodiments, the fixture mount 56 comprises a surface 60 which faces and engages with a surface 62 on the base 58 when the fastener 64 is tightened relative to the hole 68. For example, in certain embodiments, the surface 60, 62 comprises grooves and/or ridges which are complementary to grooves and/or ridges on the surface 60, 62 to increase surface friction between the surfaces 60, 62 when at a plurality of orientations. In certain embodiments, the user can tighten the fastener 64 so it clamps the surface 62 of the base 58 against the surface 60 of the fixture mount 56 to inhibit further rotation of the fixture mount 56 around the axis of the fastener 64 as long as the fastener 64 is tightly torqued in the hole 68.

FIG. 5 illustrates the locking member 20 from FIG. 4 disengaged from a contact surface 22 in the mount 14 and further removed from the light fixture 12. In certain embodiments, the contact surface 22 is formed on a smooth surface. In certain other embodiments, the contact surface 22 is formed on a rough surface. In certain embodiments, the contact surface 22 is in a divot or recess in the base 56. For example, in certain embodiments, the contact surface 22 comprises a series of recesses around a circumference of the base 56.

In certain embodiments, the body 24 can be removably mounted to the mount 14. In certain embodiments, the body 24 can be rotationally mounted to the fixture mount 56. As explained above, in certain embodiments, the first engagement structure 16 of the body 24 couples to the second engagement structure 18 on the fixture mount 56. In certain embodiments, the user couples the first and second engagement structures 16, 18 together by placing the light fixture 12 on the mount 14. In certain embodiments, when placed on the mount 14, the first and second engagement structures 16, 18 prevent the light fixture 12 from falling off the mount 14 while allowing the user to freely rotate the light fixture 12 relative to the mount 14.

In the illustrated embodiment, the body 24 comprises a hole 69. In certain embodiments, the hole 69 is threaded. In certain embodiments, the hole 69 is sized and shaped to receive the locking member 20. In certain embodiments, the locking member 20 is configured as a screw. In some embodiments, the locking member 20 can be a slotted head screw. In some embodiments, the locking member 20 can be a hex head screw. In some embodiments, the locking member 20 can be a screw with any type engagement portion, such as a Philips head or a torx head screw. Of course, the locking member 20 can be configured as any other type of fastener known to a person having ordinal skill in the art. In certain embodiments, the locking member 20 is configured as a rod, pin, clamp, or other structure.

In certain embodiments, the fixture mount 56 can have a contact surface 22 configured to be contacted by the locking member 20. In the illustrated embodiment, the contact surface 22 is formed as a groove. In the illustrated embodiment, the groove has a general C-shape. Of course, the contact surface 22 need not be formed as a groove and can other shapes. For example, the contact surface 22 can be formed as an L-shaped channel. In certain embodiments, the body 24 of the light fixture 12 becomes rotationally fixed relative to the mount 14 when the locking member or screw 20 is tightened against the contact surface or groove 22 of the fixture mount 56. In certain embodiments, engagement of the locking member 20 with the contact surface 22 of the mount 14 inhibits rotation of the light fixture 12 relative to the mount 14.

In certain embodiments, the user can loosen the locking member 20 in the hole 69 and rotate the body 24 around its longitudinal axis to a desired orientation. In certain embodiments, the user can tighten the locking member 20 so the locking member 20 contacts the contact surface 22 of the groove to inhibit further rotation of the body 24 around its longitudinal axis as long as the locking member 20 is in tight contact with the contact surface 22 of the groove. In certain embodiments, the user can loosen the locking member 20 so a distal end of the locking member 20 is not pressing against the contact surface 22 but is still disposed in the groove to prevent the body 24 from being inadvertently lifted off of the fixture mount 56 while the user rotates the body 24. In certain embodiments, the engagement of the locking member 20 with the contact surface 22 of the mount 14 inhibits rotation of the light fixture 12 relative to the mount 14. In certain embodiments, the locking member 20 secures the body 24 to the fixture mount 56 of the knuckle 54 in a preferred orientation.

In certain embodiments, the mount 14 includes a stud 70. In certain embodiments, the stud 70 can be fitted to the base 58. In certain embodiments, the stud 70 can provide a connection to a mounting stake or an electrical box.

In certain embodiments, the stud 70 can have a first end 72 and a second end 74. In certain embodiments, the first end 72 can incorporate a structure that connects the stud 70 to the base 58. For example, in certain embodiments, the structure can be a lip of the stud 70. In certain embodiments, the lip can fit within a complementary recess in the base 58. For example, in certain embodiments, the structure can be a groove in the stud 70. In certain embodiments, the lip or groove can fit within a complementary recess in the base 58.

In certain embodiments, the first end 72 can incorporate a hole 76. In certain embodiments, the hole 76 is threaded. In certain embodiments, the base 58 can include a hole 78 aligned with a portion of the stud 70, such as the hole 76, when the stud 70 is inserted into the base 58. In certain embodiments, the hole 78 is threaded. In certain embodiments, the hole 78 is a through hole that is not threaded. In certain embodiments, the light assembly 10 includes a fastener 80 configured to be installed in the through hole 78 and the threaded hole 76 in the stud 70 to lock the stud 70 and the base 58 together. In certain embodiments, as seen in FIG. 4, the stud 70 is mounted to the base 58 in a fixed position.

In certain embodiments, the second end 74 can incorporate a threaded section 82. In certain embodiments, the threaded section 82 can be configured to connect to the mounting stake or the electrical box.

Figure 6:
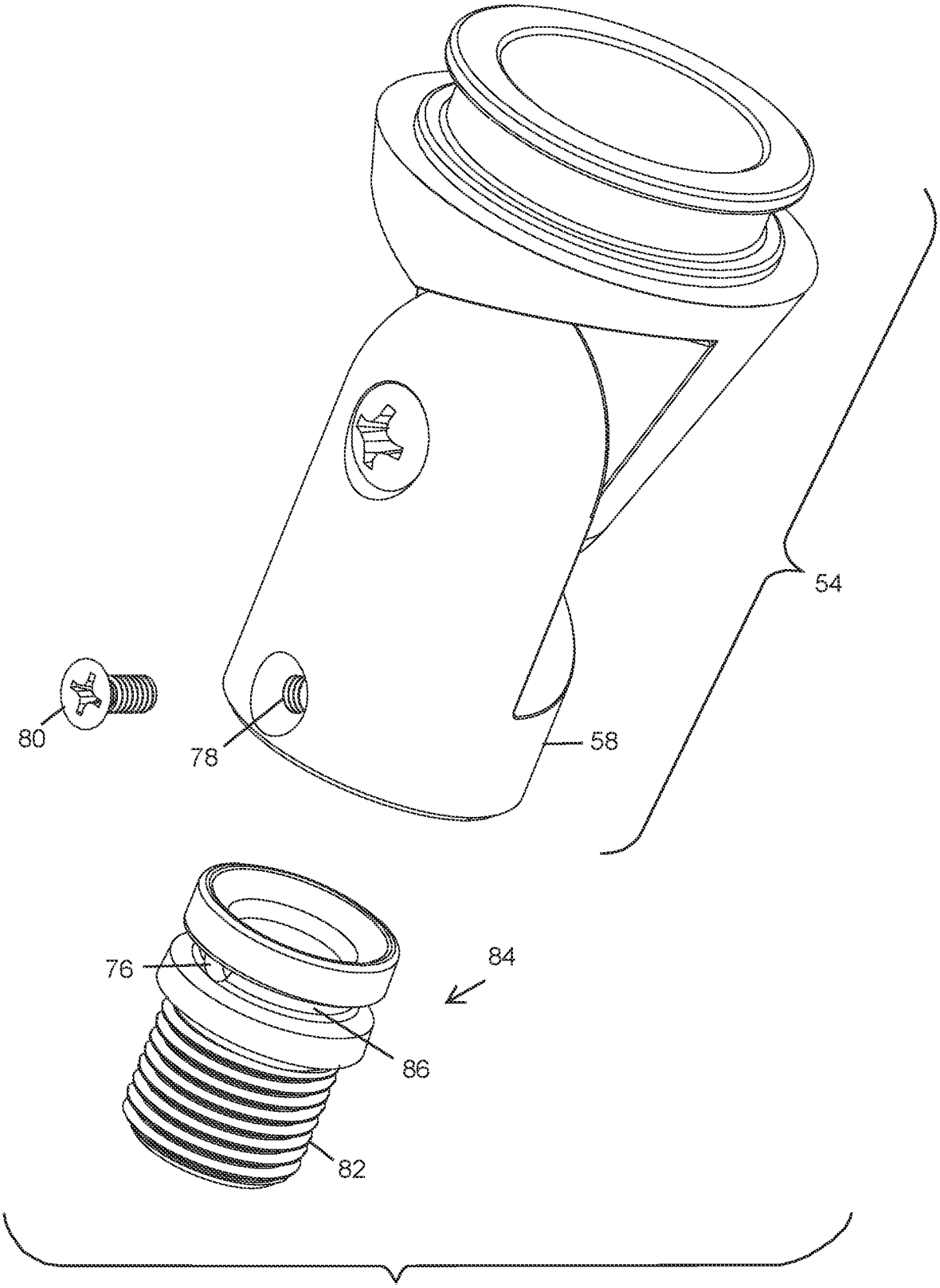
FIG. 6 is an exploded view of an alternative embodiment for attaching the stud to the base that allows rotational adjustment of the base relative to the stud.

FIG. 6 is an exploded view of alternative embodiment for attaching a stud 84 to the base 58 that allows rotational adjustment of the base 58 relative to a longitudinal axis of the stud 84. In certain embodiments, the stud 84 can be mounted to the base 58. In certain embodiments, the base 58 can be removeable and rotatably mounted to the stud 84. In certain embodiments, the structure of the stud 84 that connects the stud 84 to the base 58 can be a groove 86. In certain embodiments, the hole 78 in the base 58 can be threaded to receive the fastener 80. In certain embodiments, the hole 78 in the base 58 is aligned with the groove 86.

In the illustrated embodiment, the groove 86 has a general C-shape. Of course, the groove need not have a C-shape. For example, in certain embodiments, the groove has an L-shaped channel. In certain embodiments, the groove 86 comprises a hole 76. In certain embodiments, the base 58 becomes rotationally fixed relative to the stud 84 when the fastener 80 is tightened against the groove 86 of the stud 84. In certain embodiments, engagement of the fastener 80 with the groove 86 of the stud 84 inhibits rotation of the knuckle 54 relative to the stud 84.

In certain embodiments, the user can loosen the fastener 80 in the hole 78 and rotate the base 58 around its longitudinal axis to a desired orientation. In certain embodiments, the user can then tighten the fastener 80 so the fastener 80 contacts the groove 86 and/or enters the hole 76 to inhibit further rotation of the base 58 around its axis as long as the fastener 80 is in tight contact with the groove 86 and or in the hole 76. In embodiments that include the hole 76, the user can orient the hole 76 to line up with the hole 78 and tighten the fastener 80 in the hole 76 to provide a positive linking position between the base 58 and the stud 84.

In certain embodiments, the user can loosen the fastener 80 so a distal end of the fastener 80 is not tightly against the groove 86 and/or in the hole 76 but is still disposed in the groove 86 to prevent the base 58 from being inadvertently lifted off of the stud 84 while the user rotates the base 58. In certain embodiments, the engagement of the fastener 80 with the groove 86 of the stud 84 inhibits rotation of the base 58 relative to the stud 84. In certain embodiments, the fastener 80 secures the base 58 of the knuckle 54 to the stud 84 in a preferred orientation.

Figure 7:
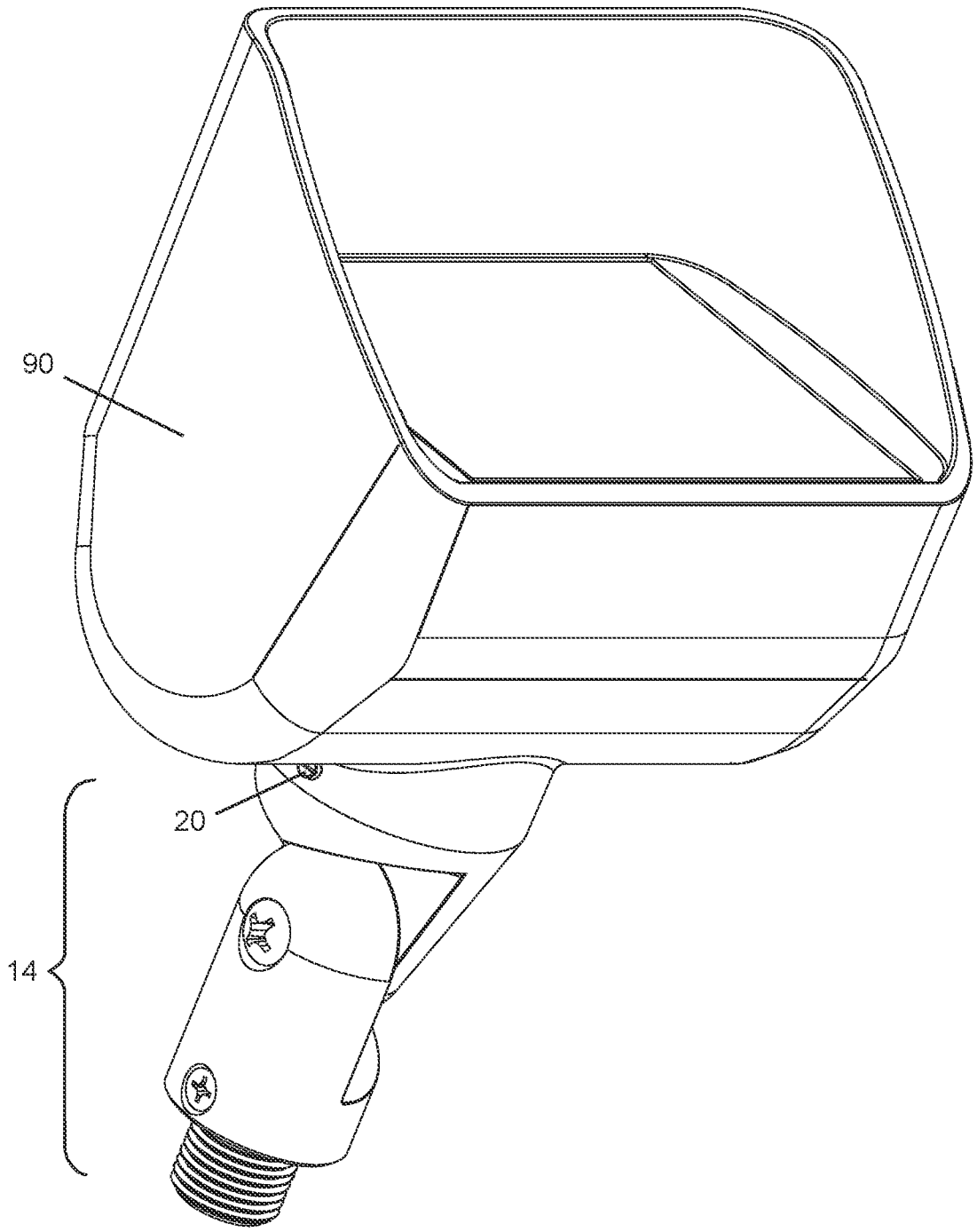
FIG. 7 is a view of a generally rectangular light fixture attached to the mount from FIG. 1 according to another preferred embodiment of the present invention.

FIG. 7 is a view of a generally rectangular light fixture 90 attached to the mount 14 from FIG. 1 according to another preferred embodiment of the present invention. The shape of the light fixture 12, 90 is not limited to the illustrated shapes and can another shape. Many different shapes of the light fixture 12, 90 can be mounted to the mount 14 such that the user can loosen the locking member 20 and rotate the light fixture 12, 90 about the mount 14.

While the above detailed description has shown, described, and pointed out novel features of the development as applied to various embodiments, it will be understood that various omissions, substitutions, and changes in the form and details of the devices illustrated may be made by those skilled in the art without departing from the spirit of the development. As will be recognized, the present development may be embodied within a form that does not provide all of the features and benefits set forth herein, as some features may be used or practiced separately from others. All changes which come within the meaning and range of equivalency of the claims are to be embraced within their scope.

The foregoing description details certain embodiments of the systems, devices, and methods disclosed herein. It will be appreciated, however, that no matter how detailed the foregoing appears in text, the systems, devices, and methods may be practiced in many ways. As is also stated above, it should be noted that the use of particular terminology when describing certain features or aspects of the invention should not be taken to imply that the terminology is being redefined herein to be restricted to including any specific characteristics of the features or aspects of the technology with which that terminology is associated.

It will be appreciated by those skilled in the art that various modifications and changes may be made without departing from the scope of the described technology. Such modifications and changes are intended to fall within the scope of the embodiments. It will also be appreciated by those of skill in the art that parts included in one embodiment are interchangeable with other embodiments; one or more parts from a depicted embodiment may be included with other depicted embodiments in any combination. For example, any of the various components described herein and/or depicted in the Figures may be combined, interchanged or excluded from other embodiments.

With respect to the use of substantially any plural and/or singular terms herein, those having skill in the art may translate from the plural to the singular and/or from the singular to the plural as is appropriate to the context and/or application. The various singular/plural permutations may be expressly set forth herein for sake of clarity.

It will be understood by those within the art that, in general, terms used herein are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations.

In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

The term "comprising" as used herein is synonymous with "including," "containing," or "characterized by," and is inclusive or open-ended and does not exclude additional, unrecited elements or method steps.

The above description discloses several materials of the present development. This development is susceptible to modifications in the methods and materials, as well as alterations in the fabrication methods and equipment. Such modifications will become apparent to those skilled in the art from a consideration of this disclosure or practice of the development disclosed herein. Consequently, it is not intended that this development be limited to the specific embodiments disclosed herein, but that it covers all modifications and alternatives coming within the true scope and spirit of the development as embodied in the attached claims.

While the above detailed description has shown, described, and pointed out novel features of the improvements as applied to various embodiments, it will be understood that various omissions, substitutions, and changes in the form and details of the device or process illustrated may be made by those skilled in the art without departing from the spirit of the invention. As will be recognized, the present invention may be embodied within a form that does not provide all of the features and benefits set forth herein, as some features may be used or practiced separately from others. The scope of the invention is indicated by the appended claims rather than by the foregoing description. All changes which come within the meaning and range of equivalency of the claims are to be embraced within their scope.

What is claimed is:

1. An adjustable landscape light assembly for securing to a surface, the light assembly comprising:

a shroud comprising a lens;

a light fixture having a longitudinal axis and comprising a body having a first end and a second end, the first end being sized and shaped to engage with the shroud, the second end having a first engagement structure, the body comprising a heat conductive material and having one or more fins;

a light module supported by the light fixture and having one or more lights configured to emit light through the lens along the longitudinal axis when the shroud is engaged with the first end of the body;

a fixture mount and a base, the base being configured to be secured relative to the surface, the fixture mount being rotatable relative to the base about an axis perpendicular to the longitudinal axis so as to adjust an elevation of the light emitted by the light module, the fixture mount comprising a second engagement structure, the second engagement structure comprising a groove sized and shaped to engage with the first engagement structure while allowing the light fixture to rotate about the longitudinal axis; and a locking member configured to move between a first position and a second position, the locking member engaging with both the first engagement structure of the light fixture and the groove of the second engagement structure of the fixture mount when in the second position to prevent the light fixture from being rotated relative to the fixture mount, the locking member being configured to maintain engagement with the light fixture but disengage from the fixture mount when moved to the first position so as to prevent the light fixture from being inadvertently lifted off of the fixture mount when the light fixture is being rotated about the longitudinal axis.

2. The adjustable landscape light assembly of claim 1, wherein the locking member engages the first and second engagement structures when in the second position.

3. The adjustable landscape light assembly of claim 1, wherein the locking member is a screw.

4. The adjustable landscape light assembly of claim 1, wherein the light fixture further comprises a hole disposed in the first engagement structure and sized and shaped to engage the locking member.

5. The adjustable landscape light assembly of claim 1, wherein the mount further comprises a contact surface disposed in the second engagement structure and positioned to be contacted by the locking member when the locking member is in the second position.

6. The adjustable landscape light assembly of claim 5, wherein the contact surface is disposed in the groove.

7. The adjustable landscape light assembly of claim 1, wherein the mount is at least partially hollow to allow a wire connected to the light module to pass therethrough.

8. An adjustable landscape light assembly for securing to a surface, the light assembly comprising:

a shroud comprising a lens;

a light fixture having a longitudinal axis and comprising a body having a first end and a second end, the first end being sized and shaped to engage with the shroud, the second end having a first engagement structure, the body comprising a heat conductive material and having one or more fins;

a mount comprising a base and a fixture mount, the base being configured to be secured relative to the surface, the fixture mount being rotatable relative to the base about an axis perpendicular to the longitudinal axis, the fixture mount comprising a second engagement structure, the second engagement structure comprising a groove sized and shaped to engage with the first engagement structure while allowing the light fixture to rotate about the longitudinal axis; and a locking member configured to move between a first position and a second position, the locking member engaging with both the first engagement structure of the light fixture and the groove of the second engagement structure of the fixture mount when in the second position to prevent the light fixture from being rotated relative to the fixture mount, the locking member being configured to maintain engagement with the light fixture but disengage from the fixture mount when moved to the first position so as to prevent the light fixture from being inadvertently lifted off of the fixture mount when the light fixture is being rotated about the longitudinal axis.

9. The adjustable landscape light assembly of claim 8, wherein the locking member engages the first and second engagement structures when in the second position.

10. The adjustable landscape light assembly of claim 8, wherein the locking member is a screw.

11. The adjustable landscape light assembly of claim 8, wherein the light fixture further comprises a hole disposed in the first engagement structure and sized and shaped to engage the locking member.

12. The adjustable landscape light assembly of claim 8, wherein the fixture mount further comprises a contact surface disposed in the second engagement structure and positioned to be contacted by the locking member when the locking member is in the second position.

13. An adjustable landscape light assembly for securing to a surface, the light assembly comprising:

a body defining a longitudinal axis and having a first end and a second end, the second end having a first engagement structure, the body comprising a heat conductive material and having one or more fins;

a shroud engaged with the first end of the body and having a lens;

a light module supported by the first end of the body and having one or more lights, the one or more lights being configured to emit light through the lens along the longitudinal axis at least when the shroud is engaged with the first end of the body;

a mount comprising a base and a fixture mount, the base being configured to be secured relative to the surface, the fixture mount being rotatable relative to the base about an axis perpendicular to the longitudinal axis so as to adjust an elevation of the light emitted by the light module, the fixture mount having a second engagement structure, the second engagement structure comprising a groove sized and shaped to engage with the first engagement structure while allowing the body to be rotated about the longitudinal axis; and a locking member configured to move between a first position and a second position, the locking member engaging with both the body and the fixture mount when in the second position to prevent the body from being rotated relative to the fixture mount the locking member being configured to maintain engagement with the body but disengage from the fixture mount when moved to the first position so as to prevent the body from being inadvertently lifted off of the fixture mount when the body is being rotated about the longitudinal axis.

14. The adjustable landscape light assembly of claim 13, further comprising a stud, the stud being configured to be secured between the base and the surface.

15. The adjustable landscape light assembly of claim 14, wherein the base comprises a hole sized and shaped to receive a fastener, and wherein the stud comprises a groove aligned with the hole and configured to be contacted by the fastener so as to prevent rotation of the base relative to the stud when the fastener is tightened against the groove.

16. The adjustable landscape light assembly of claim 13, wherein the body comprises an outer surface and the one or more fins are disposed on the outer surface.

* * * * *